US009066546B2

(12) United States Patent
Getzwiller

(10) Patent No.: US 9,066,546 B2
(45) Date of Patent: Jun. 30, 2015

(54) HAND AND FOOT YOGA GARMENTS WITH ENHANCED POSITIONAL STABILITY AND COMFORT

(76) Inventor: Jamie Getzwiller, Cardiff, CA (US)

( * ) Notice: Subject to any disclaimer, the term of this patent is extended or adjusted under 35 U.S.C. 154(b) by 0 days.

(21) Appl. No.: 12/910,794

(22) Filed: Oct. 23, 2010

(65) Prior Publication Data

US 2011/0099676 A1 May 5, 2011

Related U.S. Application Data

(60) Provisional application No. 61/280,559, filed on Nov. 5, 2009.

(51) Int. Cl.
*A41D 13/06* (2006.01)
*A41D 13/08* (2006.01)

(52) U.S. Cl.
CPC ..... *A41D 13/06* (2013.01); *A41D 13/081* (2013.01)

(58) Field of Classification Search
CPC .... A63B 71/14; A63B 71/141; A63B 71/143; A63B 71/145; A63B 71/146; A41D 19/015; A41D 19/01547; A41D 19/01558; A41D 19/01576; A41D 19/01523
USPC ..... 2/16, 20, 161.1, 161.6, 161.3, 161.8, 2/163
See application file for complete search history.

(56) References Cited

U.S. PATENT DOCUMENTS 482,647 A 9/1892 Obear
1,612,822 A * 1/1927 Jones ..... 2/161.8
1,637,181 A * 7/1927 Gillian ..... 2/161.8
2,244,445 A 6/1941 Carson et al.
2,309,710 A * 1/1943 Patterson, Jr. ..... 2/161.3
2,694,396 A * 11/1954 Paschal ..... 601/138
3,146,463 A 9/1964 Wargo
3,676,940 A 7/1972 Shively
4,103,362 A 8/1978 Blakeman
4,183,100 A 1/1980 De Marco
4,531,241 A 7/1985 Berger
4,569,707 A 2/1986 Johnson
4,657,021 A * 4/1987 Perry et al. ..... 600/300
4,793,354 A * 12/1988 Wright et al. ..... 600/300
4,867,246 A * 9/1989 Kiger ..... 172/370
4,958,384 A 9/1990 McCrane
5,402,536 A * 4/1995 Matthews ..... 2/16
5,479,660 A 1/1996 Najac
5,500,956 A 3/1996 Schulkin et al.
5,617,585 A * 4/1997 Fons et al. ..... 2/239
5,682,837 A * 11/1997 Courtney et al. ..... 119/625
5,724,836 A * 3/1998 Green ..... 66/185
5,762,621 A 6/1998 Schultz
5,774,895 A 7/1998 Baldwin
5,946,727 A * 9/1999 Wright et al. ..... 2/161.7
5,971,240 A 10/1999 Dequaine (Continued)

*Primary Examiner* — Danny Worrell
(74) *Attorney, Agent, or Firm* — Kolisch Hartwell, P.C.

(57) ABSTRACT

A yoga garment wrap, one each for the hand and the foot, each including opposite, external-surface-contact, and external-surface-non-contact side structures extending between open front and rear ends, and elastomeric, inter-digit, motion-and-escape-restraining straps, or a single strap, spanning the wrap's open front end, and interconnecting, the wrap's two side structures. The contact side structure includes an outer high-frictioning expanse, and a surface-to-surface loosely adjacent, inner moisture-wicking liner. Non-internally welted, or otherwise internally projecting seam structure units the lateral edges of the wrap's side structures.

3 Claims, 2 Drawing Sheets

(56) References Cited

U.S. PATENT DOCUMENTS

Figure 1:
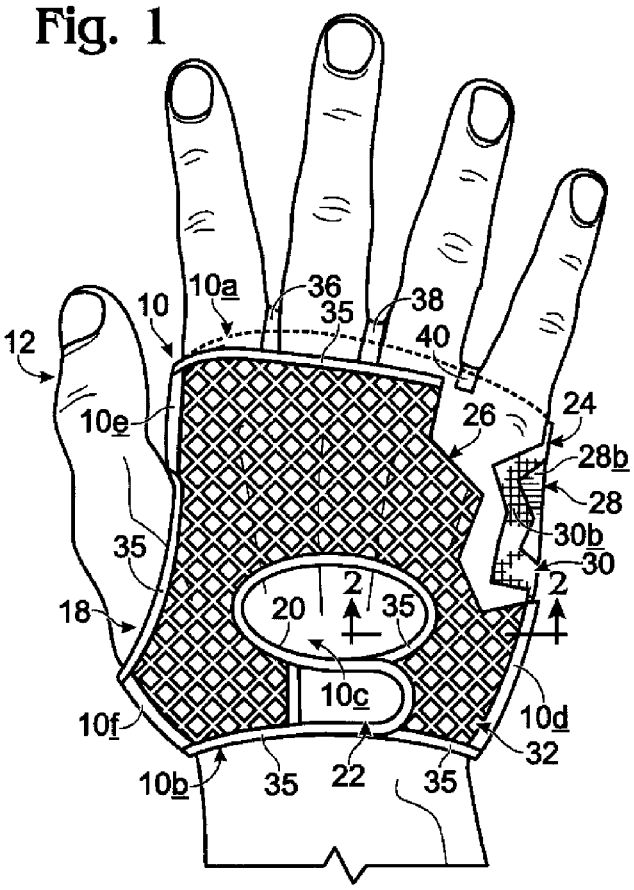

| | | | | |
|---|---|---|---|---|
| 6,138,281 | A * | 10/2000 | Chiaruttini | 2/239 |
| 6,506,170 | B2 * | 1/2003 | Morrison | 600/587 |
| 6,766,536 | B1 | 7/2004 | Aarons | |
| 7,346,935 | B1 * | 3/2008 | Patterson | 2/239 |
| 7,346,936 | B2 * | 3/2008 | Vargas et al. | 2/239 |
| 7,383,591 | B1 | 6/2008 | Getzwiller et al. | |
| 7,725,957 | B2 * | 6/2010 | Arai | 2/161.7 |
| 2002/0169389 | A1 * | 11/2002 | Morrison | 600/550 |
| 2003/0188373 | A1 * | 10/2003 | Garneau | 2/161.1 |
| 2004/0025224 | A1 * | 2/2004 | Albert | 2/159 |
| 2004/0111782 | A1 * | 6/2004 | Lenormand et al. | 2/69 |
| 2006/0026740 | A1 * | 2/2006 | Vargas et al. | 2/239 |
| 2009/0144880 | A1 * | 6/2009 | Desjardin et al. | 2/161.1 |

* cited by examiner

HAND AND FOOT YOGA GARMENTS WITH ENHANCED POSITIONAL STABILITY AND COMFORT

CROSS REFERENCE TO RELATED APPLICATION

This application claims priority to currently co-pending U.S. Provisional Patent Application Ser. No. 61/280,559, filed Nov. 5, 2009, for "Hand and Foot Yoga Garments with Enhanced Positional Stability". The entire disclosure content of that copending provisional application is hereby incorporated herein by reference.

BACKGROUND AND SUMMARY OF THE INVENTION

This invention pertains to yoga, and in particular, to wearable hand and foot devices, referred to herein variously as garments or wraps (somewhat glove-like for the hand, and sock-like for the foot) that are designed both to enhance positional stability and comfort (skin-contact, moisture-removal, and ventilation) during a yoga session. The hand and foot are referred to commonly herein as a person's, or a user's, terminal-anatomical-appendage.

Those familiar with yoga recognize that positional stability and comfort in the practice of yoga are matters that are always subject to require improvement. The present invention takes direct aim at such improvement, and offers a fresh and impressive approach to handling these two matters.

During the usual yoga session, a participant assumes various, specialized postures and positions, typically with both hands and feet engaged with some form of external structure for stable, hopefully "relatively fixed", and also hopefully relatively comfortable, support of the body, sequentially in different, determined configurations, for selected time intervals as the session progresses. Hand and foot positions involving external-structure engagements during a yoga exercise are, at least during the mentioned, selected time intervals, and in most instances, intended to remain (but often don't) comfortably, and substantially precisely (i.e., stably) in place, i.e., without slippage or appreciable change in condition, and without hand or foot skin irritation or other discomfort, such as overheating.

This idealized situation, however, does not often happen for reasons that relate, inter alia, to the facts that significant, potentially de-stabilizing forces, and uncomfortable support pressures, are involved in many conventional yoga exercises.

Various equipment approaches (garments and floor mats) have been tried in the past to achieve remedies, but many of these have not been remarkably successful or satisfactory. For example, made available today for yoga practice are many kinds of frictioning-surface mats, as well as various styles of specialized hand and foot glove-like and sock-like garments. These prior art devices, however, have, in certain ways, "missed the mark", chiefly because of what appears to be a failure both (a) to deal with what can be thought of as a dual-nature character of positional-stability management, and (b), to attend to the associated need to consider garment internal construction and its bearing upon both stability control and comfort. These stability- and comfort-associated points, I have discovered, are collaboratively linked, and while they may, at first glance, appear to be of only modest concern, they are not modest at all.

The devices proposed by the present invention, in practice, dramatically dispel whatever sense of modest importance one might initially ascribe to the linked issues just mentioned.

The present invention concerns, generally, yoga hand and foot garments, referred to herein also, and variously, as wraps, as gloves and as socks, and specifically, very carefully considered, newly conceived, hand and foot wraps possessing unique features that enhance the yoga experience (1) by notably maximizing stable yoga positioning in comparison with the stabilizing performances of conventional hand and foot yoga garments, while at the same time (2) significantly minimizing certain discomfort difficulties, discussed below herein, that are sometimes experienced with various, prior art hand and foot garments.

Considering a conventional setting for and in relation to which the present invention offers improvement, and using the hand wearing a glove as an illustration, wherein a yoga pose is assumed which involves significant force delivered through the arm and hand and glove to some external support surface, with considerable pressure existing in between the hand-worn glove and that support surface, and particularly where the axis of the arm lies at a relatively low angle in relation to the external support surface, there is a very clear and natural tendency (1) for the hand to tend to slip forwardly in the glove, even to the point of attempting to escape the glove, and at the same time, and to some extent triggered by such slippage, (2) for the "grip" between the glove and the support surface to fail.

This kind of situation which, of course, is not acceptable, is one that is particularly well addressed by the features (set forth in detail below) of the present invention. These features are ones which, while permitting a very limited, and truly extremely modest, version of the just-mentioned, hand-relative-to-glove, "natural-tendency" slip motion under the circumstances described, otherwise controllably minimize the likelihood of both (1) the hand undesirably slipping forwardly extensively from the glove, and at the same time (2), the failure of stable frictional engagement between the glove and the external support surface.

In addition, it is well understood that once a traditional yoga session has begun, sweating occurs, and it is important that this be dealt with, and that the hand be kept as sweat-free, cool and temperature-comfortable as possible. Here, too, the present invention offers comfort-control features that deal with these sweat- and cooling-associated matters.

Further in the realm of comfort, and still with respect to the-hand-in-glove illustrative situation, it is important that anything internally exposed in a glove, such as seam structure which joins glove components, not produce an irritant to the hand under the same kinds of force and pressure conditions mentioned above. Here, too, the structure of the present invention successfully addresses this concern.

The present invention offers a unique structure which responds to all of these considerations by enhancing comfort and stability during a user's yoga practice. More specifically, the garment of the present invention takes the form of a wearable structure for the hand or the foot, having external-structure contact and non-contact sides joined through a uniting seam whose welt-like bulk is entirely external in nature, definitively avoids introducing any irritant on the inside of the garment to the hand or foot wearing it.

On its external-structure contact side, the proposed garment features the exposed outer surface of a high-frictioning material which is non-perforate. The inner surface (within the garment) of this high-frictioning material, is covered by a freely engaging (i.e., capable of exhibiting a very limited amount of surface-to-surface relative motion in its relationship to the frictioning material) moisture-wicking liner which wicks away palm and underfoot sweat for enhancing both comfort and positional stability conditions. On its external-surface noncontact side, the garment includes, for the hand, a perforate ventilating fabric, and for the foot, a thin expanse of a highly stretchy fabric.

Additionally, the garment of the present invention, adjacent its open front end, includes for the foot, one, and for the hand plural, inter-digit elastomeric strap(s) that receive(s), inter-digitally, the digits of the user's hand or foot further to stabilize hand or foot positioning inside the garment. These straps, because of their elasticity, importantly allow, but permit only a very limited amount of, forward-motion slip of the hand or foot relative to the associated garment during a yoga session. This "allowance" accommodates the kind of natural slip propensity mentioned above, without permitting so much slip that positional stability might be jeopardized.

These and other special features and advantages of and offered by the present invention will become more readily apparent as external-structure contact the detailed description of it which is presented below is read in conjunction with the accompanying drawings.

DESCRIPTIONS OF THE DRAWINGS

FIG. 1 is a top plan view, with certain portions therein broken away to illustrate details of construction, showing a hand wrap form of the garment invention disposed in place on a wearer's right hand—this hand being positioned with its palm facing away from the viewer in the figure. The breakaway parts of this figure, pictured adjacent its right side, break successively "downwardly" into or toward the plane of the figure, first through a perforate, ventilating mesh fabric expanse which covers the upper, back side of the hand, next through a portion of the illustrated hand to reveal an expanse of a "wrap-inside" moisture-wicking fabric, and next (and last) through the moisture-wicking fabric to reveal an expanse of a high-frictioning material which is disposed on the palm underside of the hand. An upwardly, modestly curving dashed line in this figure illustrates the curved, upper edge of the mostly hidden palm side of the hand wrap—a feature which positions a central, inter-digit, retainer strap (below described in the context of its two, adjacent neighbors) in a manner adding to comfort where a ring is worn by the user.

Figure 2:
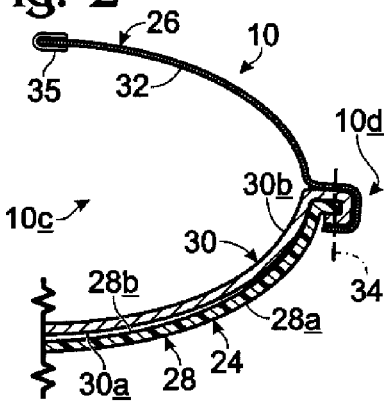

FIG. 2 is an enlarged, fragmentary, transverse, cross-sectional view, with the hand removed, taken generally along the line in 2-2 in FIG. 1, showing the several hand-wrap material layers, or expanses, and especially picturing the configuration of certain, special, lateral seam construction which is formed in the wrap of FIG. 1 in accordance with an important feature of the invention.

Figure 3:
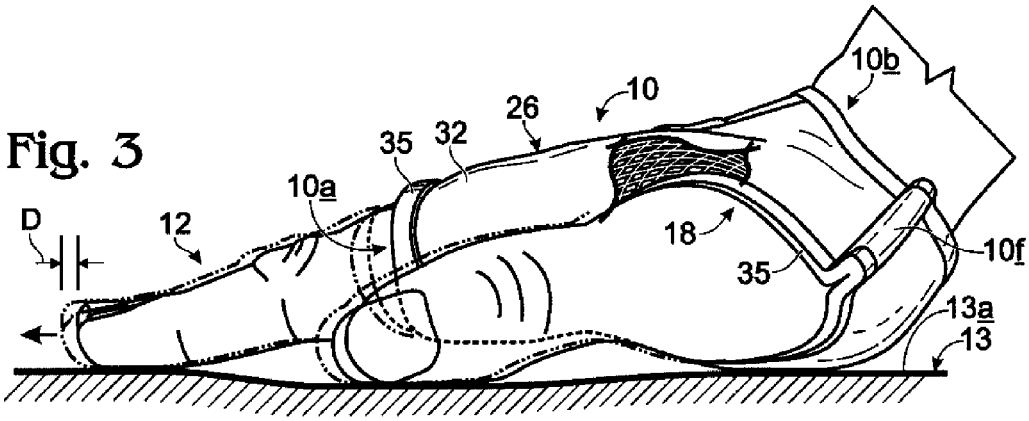

FIG. 3 is an elevation drawn on about the same scale as that employed in FIG. 2, taken generally from the left side of FIG. 1, rotated 90-degrees counterclockwise, and illustrating, in solid lines, (a) the hand disposed in essentially the same position shown for it relative to the wrap in FIG. 1, and in dash-double-dot lines, (b) the hand moved limitedly forwardly (i.e., somewhat to the left in this figure) relative to the hand wrap, as accommodated and ultimately constrained by elastomeric inter-digit straps that form an important part of the illustrated wrap in accordance with the present invention. FIG. 3, immediately above the base of the thumb, presents a fragmentary surface-patch illustration of the mentioned ventilating mesh fabric expanse which covers the upper, back side of the hand. Also shown in this figure is a fragmentary portion of an external support structure, such as a floor mat, having an upper surface with which the hand and its worn hand wrap are, collectively, frictionally engaged as if involved in a traditional, yoga, force-creating, body-support position.

Figure 4:
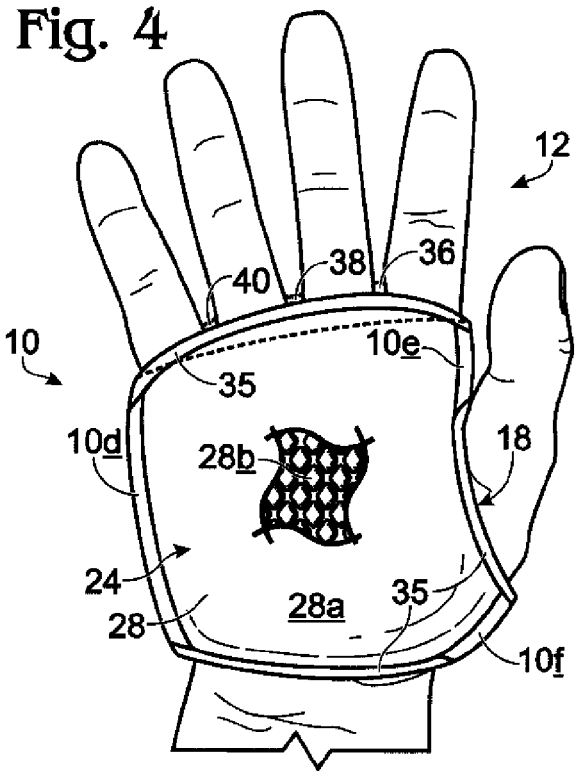

FIG. 4 is a bottom plan view, drawn on a somewhat smaller scale than that employed FIG. 1, illustrating what is shown in FIG. 1 from the palm side of the hand. A central fragmentary area in this drawing figure has included in it a stylized representation of a three-dimensional, "dappled bumpiness" pattern which may be included in that externally exposed surface in the hand wrap which is intended frictionally to grip an external surface during yoga exercise. This view clearly pictures the earlier-mentioned upper curved edge of this side of the hand wrap, and a straight, dashed line shows the hidden, upper edge of what is here the hidden side of the wrap.

Figure 5:
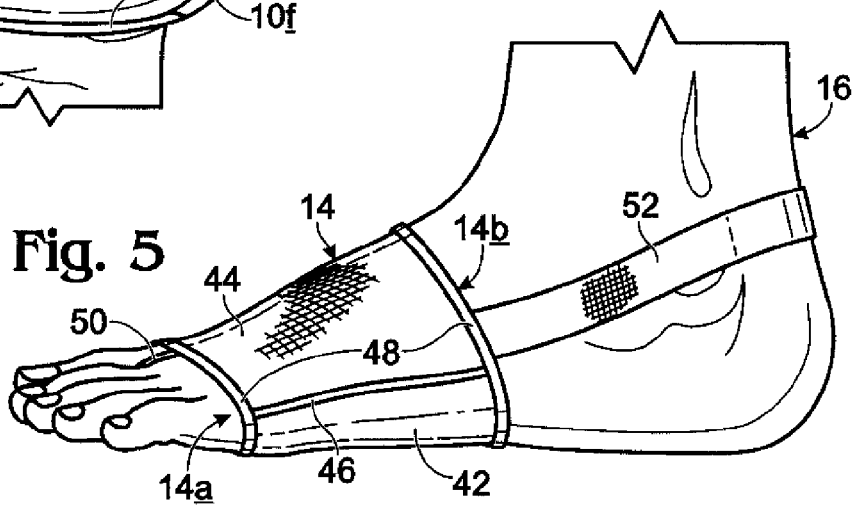

FIG. 5 is a left-side elevation of a wearer's left foot shown wearing a foot wrap form of the garment invention. This figure is drawn approximately on the same scale as that employed in FIG. 4. Cross-hatch surface-marking patches are included on two, different portions of the foot wrap in this figure to indicate elastomericity of the related component materials.

Components and dimensions employed in these five figures are not necessarily drawn to scale.

DETAILED DESCRIPTION OF THE INVENTION

Turning now to the drawings, and referring first of all generally to all five of the drawing figures, indicated generally at 10 in FIGS. 1-4, inclusive, is a yoga garment in the form off a glove, or hand wrap, which, in FIGS. 1, 2 and 4 is shown as being worn on a wearer's the right hand, shown fragmentarily at 12, for which it is appropriately and conventionally shaped. As mentioned above in the description of FIG. 3, in FIG. 3, hand 12 and hand wrap 10 are pictured, collectively, frictionally engaged with the upper surface 13*a* of a floor mat 13 (external support structure) as if involved in a traditional, yoga, force-creating, body-support position. Similarly, shown generally at 14 in FIG. 5 (though without an illustration of the presence of any external support surface) is another yoga garment in the form of a sock, or foot wrap, pictured as being worn on a wearer's left foot, illustrated fragmentarily at 16, for which the foot wrap also is appropriately and conventionally shaped.

These two garments, generally conventionally configured, as mentioned, in quite familiar, overall shapes which do not form any part on the present invention (except for the special, upper-edge curvature existing in the palm-side structure of the hand wrap, as, and for the reason, pointed out above), possess special features, shortly to be described, incorporated within them in accordance with the present invention. The conventional overall shapes of these two styles of garments are, accordingly, not discussed herein in any detail.

It will be apparent to those skilled in the art that, whereas two garments have been illustrated in these five figures specifically shaped to fit the right-hand and the left foot of a wearer, similar garments, shaped appropriately, i.e., laterally differently, are to be made in accordance with the invention for wearing on the opposite hand and foot of a wearer. It will also be apparent that these garments may be made in different, conventionally understood, different sizes, though, as will be discussed below, the foot garment is furnished with an upper, broad expanse of a stretchy fabric that will allow the garment to fit readily a relatively wide range of foot sizes.

Focusing attention now more specifically on FIGS. 1-4, inclusive, and reiterating something just mentioned above, except with respect to certain special details of construction that are very relevant to features offered by the present invention, the hand wrap which is there illustrated is otherwise quite conventional in configuration, in that it possesses, basically, the shape and configuration accommodating the style of hand fitment which characterizes a large number of different types of different-sport, etc., "athletic" gloves. In other words, it will be evident to those skilled in the art from viewing these four drawing figures that hand wrap 10 is shaped appropriately to fit around a wearer's hand as shown, with an appropriate size which is completely a matter of maker choice, so as to cover the back of the hand and the palm.

Wrap 10 possesses a lateral opening 18 to accommodate through-passage extension of the thumb, a generally open, front, finger-extension end 10*a* to allow for extension (as illustrated) of the four fingers, or digits, an appropriate, open rear end 10*b* to allow for insertion of the hand for wearing purposes, an open inside 10*c* (see especially FIG. 2) for receiving hand 12 as shown, communicating with the open front and rear ends, lateral seam structure including seams 10*d* (see especially FIG. 2), 10*e*, 10*f* on the sides of the wrap as shown, and, next to a window 20, an appropriate, releasable, preferably Velcro® style, closure 22 which opens and closes the rear end of the wrap for installation and removal relative to the hand. These general aspects of hand wrap 10, except for the mentioned seam structure, are more or less conventional in construction.

Continuing with description of hand wrap 10, this wrap includes what are referred to herein as an external-surface-contact, or bottom, side structure 24 and an external-surface-non-contact, or top, side structure 26.

Side structure 24, the palm side of the wrap, includes two components—(1) a non-perforate, high-frictioning, thermoplastic, elastomeric material expanse 28 formed of any suitable material of this character which offers high-friction engagement with any external surface which it contacts under pressure, such as surface 13*a* shown in FIGS. 3, and (2) a suitable, conventional-material, moisture-wicking liner 30 which is substantially coextensive with component 28. These two components "share" the upper edge curvature pointed out earlier herein.

Expanse 28 is continuous, in a non-perforate sense, to its perimetral boundaries, which are generally illustrated, and can be seen particularly well, in FIG. 4, and possesses an outer, exposed surface 28*a* which is the surface in wrap 10 that directly contacts an external support surface during a yoga exercise, such as surface 13*a* in mat 13, and an inner, non-exposed surface 28*b* which faces inwardly toward the inside 10*c* in wrap 10. Exposed surface 28*a* may, if desired, optionally have a three-dimensionally dappled, bumpiness pattern such as that shown fragmentarily at 28*b* in FIG. 4.

Liner 30 includes an outer, non-exposed surface 30*a* which directly faces and freely engages, in a slightly spaced character as can be seen in FIG. 2, inner surface 28*b* in component 28, and an inner exposed surface 30*b* which is directly exposed to the inside 10*c* of wrap 10. Liner surface 30*b* directly engages the palm of hand 12, and functions, in a comfort-giving fashion, to wick moisture away from, and thereby cool, the palm of the hand during a yoga session. Preferably, liner 30 is made of a blend including about 80% polyester and about 20% polyamide.

Forming side structure 26 is a single-layer, perforate (mesh-like) ventilation material, or expanse, 32 which has the outline clearly pictured in FIG. 1, and in which is formed previously mentioned window 20. Expanse 32 has appropriately attached to it, adjacent window 20, previously mentioned Velcro®-based releasable closure structure 22. Preferably, expanse 32 is made of 100% polyester.

An important feature of the invention which plays a significant role in enhancing comfort during a yoga session, and which also thereby minimizes undesirable, comfort-seeking hand motions during a yoga pose—motions that could, by virtue of the practical linkage which undisturbed hand comfort possesses with positional stability, destabilize the frictional grip achieved by wrap expanse 28—is the structure of previously mentioned, major, lateral seam structure which includes the three, major, lateral seams shown at 10*d*, 10*e*, 10*f* that join the lateral sides of side structures 24, 26. What is especially important to note, and this aspect of these seams is clearly pictured in detail for seam 10*d* in FIG. 2, is that the entirety of what exists quite naturally as a seam-joinery welt—joinery being accomplished herein through stitching, such as the stitching represented schematically by dashed line 34 in FIG. 2—is located completely on the outside of wrap 10, whereby what exists within the wrap's inside 10*c* along the existing seam line is quite smooth (as very clearly seen in FIG. 2) and non-irritating to the sides of a hand wearing wrap 10. Thus, with respect to each of seams 10*d*, 10*e*, 10*f*, there is essentially no welt-like projection which extends to the inside of wrap 10.

The remaining, otherwise exposed edges of the two components which make up side structure 24, and the edge of the single layer of material which makes up side structure 26, are finish-banded by a thin, stitched-in-place fold of a modestly elastomeric fabric ribbon, such as that shown at 24 in the figures, this ribbon preferably being made about 92% of nylon and about 8% of stretchable Lycra. Importantly, these banded-finished edges in the illustrated portions of the side structures in wrap 10 are designed to function in a manner which will also not introduce skin-contact irritation to a hand wearing the wrap.

Completing a description of the construction of hand wrap 10, extending across the open front end of the wrap, and spanning the space between side structures 24, 26 at the locations shown, are three, elongate, laterally spaced, elastomeric straps 36, 38, 40 which span the gap between these two side structures, and which form what is referred to herein as inter-digit strap structure. These straps are formed of any suitable elastomeric ribbon-like material, have a lateral width between their laterally spaced edges of about ⅜-inches, have appropriate spaces disposed between them, and are designed to restrain the hand, during a yoga session, from extending or shifting forwardly outwardly from the glove beyond a very modest amount such as the amount illustrated by dimension D pictured in FIG. 3. Dimension D herein lies preferably in the range of about ½- to about ¾-inches. These elastomeric straps, in cooperation with the loose, surface-to-surface engagement which exists between liner 30 and expanse 28, purposely permit a user's hand to shift naturally, under force and pressure, slightly forwardly if necessary during a yoga exercise without shifting so far as to jeopardize frictional engagement of the hand wrap with an external surface.

Turning attention now to FIG. 5 in the drawings, and describing the construction of foot wrap 14, in many ways, at least with respect to the main structural components of this foot wrap, ifs construction is quite similar to that which has just been described for hand wrap 10. Accordingly, only those particular portions of the foot wrap which noticeably distinguish it from the hand wrap, other than its obvious and easily observed and understood shape differentiation as dictated by the necessity to be worn by the foot as illustrated in FIG. 5, will be explained.

In general terms, the foot wrap includes open front and rear ends 14*a*, 14*b*, respectively, and essentially the same kinds of external-surface-contact and external-surface-non-contact side structures as those included in the hand wrap. The relevant external-surface-contact, or bottom, side structure is shown generally at 42 and the external-surface-non-contact, or top, side structure is shown generally at 44.

The lateral edges of these two side structures are joined through a pair of major seams, such as the single seam shown at 46 in FIG. 5. These seams are essentially the same in construction, or very nearly the same, as those described above for seams 10*d*, 10*e*, 10*f* in the hand wrap. The other edges of side structures 44, 42 are banded in the manner illustrated for the hand wrap, with specific structural-style and material-nature reference here made to previously described edge banding 35. The edge banding in the foot wrap is shown at two locations generally at 48.

Side structure 42 to is essentially the same as previously described side structure 24 in hand wrap 10, in the sense of possessing a two-layer construction substantially like that described for side structure 28. External-surface-non-contact side structure 44 differs a bit from previously described side structure 26 in that, instead of being formed of a perforate ventilation expanse, it is instead formed by a thin layer of a stretchy fabric material, such as a Lycra® expanse, or an expanse made of any other suitable, thin, stretchy material. This stretchy material is intended to accommodate fitment of foot wrap 14 to a relatively wide range of foot sizes Included adjacent the open front end of wrap 14 is a single, elongate, elastomeric, inter-digit strap 50 which is intended to fit between the big and next-adjacent toe when the foot wrap is worn as shown in FIG. 5. This single strap has the same functionality as that discussed for previously described straps 36, 38, 40 in hand wrap 10. Also included in the foot wrap is an additional, elongate, elastomeric strap 52 which has its opposite ends joined, as by stitching, to laterally opposite sides of the open rear end of the foot wrap, near the major lateral seams, such as seam 46, so as to enable elastomeric stabilizing wrapping around the ankle and heel in the foot when the foot wrap is worn as shown in FIG. 5.

The present invention, in its preferred and best mode forms for a hand wrap and a foot wrap, has thus been illustrated and described. In its contribution to the art, the invention recognizes that it is important that nothing about such a yoga garment of the types generally mentioned should lean toward permitting instability either in (a) hand or foot relative positioning within-the-garment or in (b) garment-to-external-surface, secure-contact (high-friction) positioning. This means, of course, that when such a garment is worn, it should both (a) remain stably in a secure and substantially (slight, force-induced relative motion permitted) fixed and captured position on a practitioner's hand or foot, and (b) should additionally grip, in a robust, high-friction manner, whatever external surface structure is employed to furnish an external contact surface for the holding of a yoga position.

The just-mentioned "substantially" fixed positioning on a hand or foot is a special point of interest regarding this invention. This point recognizes the additional importance, embodied intentionally as a special quality of the present invention, that a yoga garment be structured for behaving so as to allow a very small, purposeful amount of high-force-induced relative motion between it and a hand or a foot—a relative motion which cannot be allowed to lead to escape (or major protrusion) of the hand or foot from the associated garment, but one which definitively accommodates the natural tendency for such motion to occur under high-force positional support yoga conditions. Such a garment must nonetheless be structured to allow for such internal, slight, relative hand-foot-garment motion without there also being any appreciable tendency for such action to dislodge the required, stable frictional engagement between garment and engaged, external support structure.

The present invention clearly features a behavior which permits the important and natural, mentioned, slight, captured (i.e., no escape) relative motion between hand or foot and garment, but permits this without any attendant, stability-dislodging relative motion between garment and external support structure.

In the bargain, so to speak, of all of this, such a garment should be comfortable enough that it does not overheat or otherwise irritate the hand or foot in any manner—something which might encourage a certain amount of destabilizing hand or foot maneuvering to achieve comfort during yoga practice.

The structure of the present invention accomplishes all of the above in a remarkably simple arrangement of components.

Thus, preferred and best-mode illustrations and descriptions of the hand and foot yoga garments made in accordance with the present invention have been presented. Regarding these, I appreciate that variations and modifications may come to the minds of those generally skilled in the art based upon a reading and viewing of the herein contained invention disclosure content, and it is my intention that all such variations and modifications will be construed to be within the scopes of the following claims.

I claim:

1. A yoga glove having an inside and an outside, and comprising a single-layer top side including a perforate, ventilation layer exposed on the outside of the glove directly to the atmosphere, and a dual-layer bottom side forming a contact region which contacts and presses against a floor structure when a user's palm is applied to the floor structure, and a lateral region around a perimetral hand portion which does not contact the floor structure when the user's palm is applied to the floor structure, the bottom side being joined through lateral region seam structure to said top side, the bottom side having a pair of independent, mutually coextensive layers possessing spaced, confronting, and freely engaging surfaces, said independent layers including (1) a high-frictioning material outer layer having inner and outer surfaces and a perimetral boundary, continuous and non-perforate in nature to its said boundary, with its said outer surface being disposed on the outside of the glove and adapted for external-surface frictional engagement, and its said inner surface, which is one of said spaced, confronting, and freely engaging surfaces, facing toward the inside of the glove, and (2) a moisture-wicking inner layer also having inner and outer surfaces, with its said outer surface being the other one of said spaced, confronting, and freely engaging surfaces, and its said inner surface being exposed to the inside of the glove, wherein the high-frictioning material outer layer and the moisture-wicking inner layer are freely engaged and spaced over the entire contact region of the bottom side of the glove.

2. The yoga glove of claim 1, wherein the lateral seam structure is external to the glove, with no welt-like projection extending to the inside of the glove.

3. A yoga glove having an inside and an outside, and comprising a single-layer top side including a perforate, ventilation layer exposed on the outside of the glove directly to the atmosphere, and a dual-layer bottom side forming a contact region which contacts and presses against a floor structure when a user's palm is applied to the floor structure, and a lateral region around a perimetral hand portion which does not contact the floor structure when the user's palm is applied to the floor structure, the lateral surface of the bottom side being joined through lateral seam structure to said top side, the bottom side having a pair of independent, mutually coextensive layers, said independent layers including (1) a high-frictioning material outer layer having inner and outer surfaces and a perimetral boundary, continuous and non-perforate in nature to its said boundary, with its said outer surface being disposed on the outside of the glove and adapted for external-surface frictional engagement, and its said inner surface facing toward the inside of the glove, and (2) a moisture-wicking inner layer also having inner and outer surfaces, with its said outer surface facing toward the outside of the glove, and its said inner surface being exposed to the inside of the glove, and wherein the lateral seam structure is external to the glove, with no welt-like projection extending to the inside of the glove.

* * * * *